US011828490B2

(12) United States Patent
Smith et al.

(10) Patent No.: US 11,828,490 B2
(45) Date of Patent: Nov. 28, 2023

(54) CERAMIC HEATER FOR HEATING WATER IN AN APPLIANCE

(71) Applicant: LEXMARK INTERNATIONAL, INC., Lexington, KY (US)

(72) Inventors: Jerry Wayne Smith, Irvine, KY (US); David Anthony Schneider, Lexington, KY (US); Jichang Cao, Lexington, KY (US); Virgil Johnson, Jr., Versailles, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 276 days.

(21) Appl. No.: 17/236,427

(22) Filed: Apr. 21, 2021

(65) Prior Publication Data

US 2021/0333012 A1 Oct. 28, 2021

Related U.S. Application Data

(60) Provisional application No. 63/014,799, filed on Apr. 24, 2020.

(51) Int. Cl.

| | |
|---|---|
| ***F24H 1/10*** | (2022.01) |
| ***H05B 3/82*** | (2006.01) |
| ***H05B 3/16*** | (2006.01) |

(52) U.S. Cl.

CPC ..... *F24H 1/103* (2013.01); *H05B 3/16* (2013.01); *H05B 3/82* (2013.01); *H05B 2203/013* (2013.01); *H05B 2203/021* (2013.01)

(58) Field of Classification Search

CPC ..... F24H 1/103; F24H 1/121; F24H 1/202; H05B 3/16; H05B 3/20; H05B 3/265; H05B 3/82; H05B 2203/013; H05B 2203/021

See application file for complete search history.

(56) References Cited

U.S. PATENT DOCUMENTS

| | | | | |
|---|---|---|---|---|
| 4,039,777 | A | 8/1977 | Baker | |
| 5,581,876 | A | 12/1996 | Prabhu et al. | |
| 5,663,702 | A | 9/1997 | Shaw, Jr. et al. | |
| 6,118,102 | A * | 9/2000 | Slegt | H05B 3/82 219/548 |
| 6,150,636 | A | 11/2000 | Bogdanski et al. | |

(Continued)

OTHER PUBLICATIONS

"5 Reasons Why Aluminum Forging is Better Than Aluminum Casting," https://web.archive.org/web/20181120150449/https://www.indiaforging.com/blog/5-reasons-why-aluminium-forging-is-better-than-aluminium-casting.php (Year: 2018).*

(Continued)

*Primary Examiner* — Justin C Dodson

(57) ABSTRACT

An appliance for heating fluid includes a reservoir for holding the fluid during use. One or more ceramic heaters mount with the reservoir to heat the fluid. The heater includes electrically resistive traces thick-film printed on a substrate. The heaters optionally mount with a heat transfer element having a relatively large surface area. The heat transfer element typifies a conductive element, such as an aluminum plate of forged aluminum. The plate has cavities to retain the heaters or sections fitted about heaters. Holes through a thickness of the plate induce turbulent fluid flow as the fluid freely passes there through during use. Heater control and mounting are still other aspects of the technology.

5 Claims, 7 Drawing Sheets

(56) References Cited

U.S. PATENT DOCUMENTS

| | | | | |
|---|---|---|---|---|
| 6,960,741 | B2 | 11/2005 | Hamilton et al. | |
| 7,005,611 | B2 | 2/2006 | Hamilton et al. | |
| 7,241,131 | B1 | 7/2007 | Booth et al. | |
| 7,336,919 | B2 | 2/2008 | Beach et al. | |
| 7,352,988 | B2 | 4/2008 | Beach et al. | |
| 8,064,816 | B2 | 11/2011 | Campbell et al. | |
| 9,417,572 | B2 | 8/2016 | Hamilton et al. | |
| 9,551,962 | B2 | 1/2017 | Campbell et al. | |
| 10,025,244 | B2 | 7/2018 | Campbell et al. | |
| 10,274,876 | B2 | 4/2019 | Cao et al. | |
| 2004/0035843 | A1 | 2/2004 | Hamilton et al. | |
| 2005/0145616 | A1* | 7/2005 | Ptasienski | B29C 45/1782 219/535 |
| 2006/0127686 | A1 | 6/2006 | Meloni | |
| 2007/0278203 | A1 | 12/2007 | Creteau et al. | |
| 2008/0083746 | A1 | 4/2008 | Lucas et al. | |
| 2008/0224786 | A1 | 9/2008 | Stolpman et al. | |
| 2009/0095169 | A1 | 4/2009 | York | |
| 2009/0200287 | A1* | 8/2009 | Kim | H05B 3/32 219/399 |
| 2010/0124448 | A1 | 5/2010 | Beach et al. | |
| 2013/0016462 | A1* | 1/2013 | Howitt | A47J 27/2105 361/679.01 |
| 2014/0131904 | A1* | 5/2014 | Tang | B01F 23/20 261/157 |
| 2014/0369730 | A1 | 12/2014 | Bayerle et al. | |
| 2016/0367061 | A1 | 12/2016 | Chou | |
| 2017/0023894 | A1 | 1/2017 | Cao et al. | |
| 2017/0328651 | A1* | 11/2017 | Rozga | F28D 7/10 |
| 2019/0196372 | A1 | 6/2019 | Cao et al. | |
| 2020/0253350 | A1 | 8/2020 | Bayerle et al. | |
| 2020/0253409 | A1 | 8/2020 | Cao et al. | |

OTHER PUBLICATIONS

U.S. Appl. No. 17/147,907, filed Jan. 13, 2021 (Smith et al.).
U.S. Appl. No. 17/151,879, filed Jan. 19, 2021 (Smith et al.).
U.S. Appl. No. 17/151,891, filed Jan. 19, 2021 (Smith et al.).

* cited by examiner

CERAMIC HEATER FOR HEATING WATER IN AN APPLIANCE

This utility application claims priority from U.S. Provisional Application Ser. No. 62/014,799, filed Apr. 24, 2020, whose entire contents are incorporated herein by reference.

FIELD OF THE DISCLOSURE

The present disclosure relates to appliances having heated fluids, such as dishwashers, clothes-washing machines, water heaters, and the like. It relates further to heating fluid with one or more ceramic heaters having relatively low thermal mass and high power density. The ceramic heaters typify thick-film printed devices controlled singularly or jointly. They exist in conjunction with or without other heat transfer elements and turbulent-flow technologies that further reduce thermal mass.

BACKGROUND

Typical heated-water appliances have one or more nichrome, tubular heating elements that convert electricity to heat via Joule heating, often called calrods. Calrods sit near a bottom or in a sump of a water reservoir of appliances to heat water to a predetermined temperature or to generate steam. In a clothes-washing appliance, a calrod usually sits in a sump submerged in the water. While working relatively well for heating the water to a target temperature, the design suffers when generating steam because of the relatively large volume of water required to submerge the calrod. The design requires excessive energy and time to start steam generation. In a dishwasher appliance, a circulating pump sprays water onto dishes and water sprinkling down becomes heated by a calrod as it falls onto the surface of the calrod. Excessively long times are needed for the water to reach desired temperatures in comparison with intentionally placing water in complete contact with the heated surface area of the calrod. The inventors, thusly, identify a need to improve both energy efficiency and times-to-heat fluids in appliances. The inventors further seek to overcome problems associated with using calrods to heat water in appliances.

SUMMARY

An appliance for heating fluid includes a reservoir for holding the fluid during use. One or more ceramic heaters mount with the reservoir to heat the fluid. The heater includes electrically resistive traces thick-film printed on a substrate. Electrical conductors, thermistors, and glass(es) are also typical. The heaters optionally mount with a heat transfer element having a relatively large surface area. The heat transfer element typifies a conductive element, such as an aluminum plate of forged aluminum. The plate may include cavities to retain the heaters or sections fitted about heaters. Gap fillers may reside between the ceramic heaters and heat transfer elements to improve heating transfer and efficiency. Holes through a thickness of the plate induce turbulent fluid flow as the fluid freely passes through during use. Heater control and mounting are still other aspects of the technology.

BRIEF DESCRIPTION OF THE FIGURES

The accompanying figures incorporated in and forming a part of the specification illustrate several aspects of the present disclosure and together with the detailed description serve to explain the principles thereof. In the views.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1A:
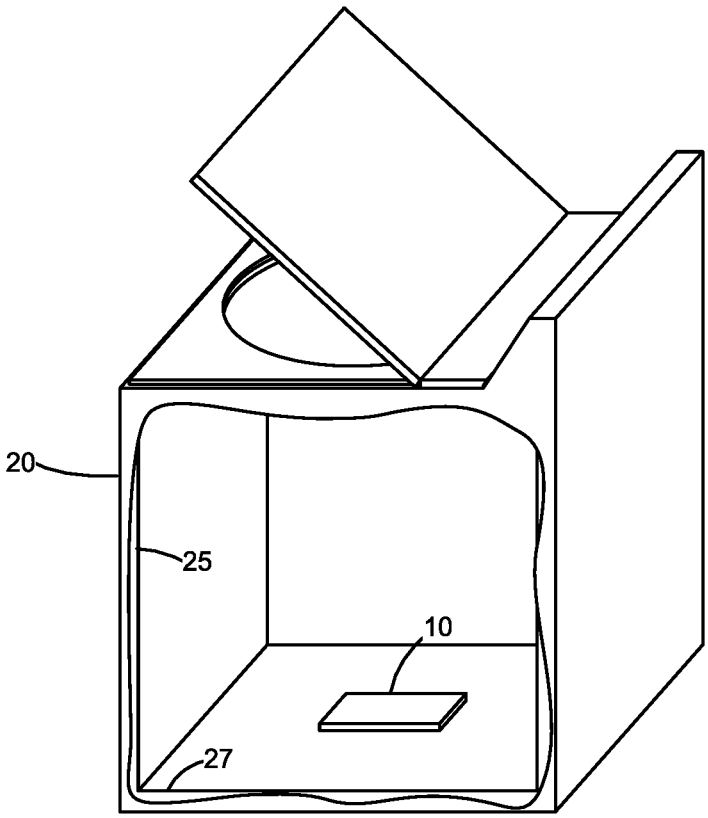
FIGS. 1A and 1B are simplified diagrammatic views of appliances in the form of clothes-washing machines having a ceramic heater and its placement location.
Figure 1B:
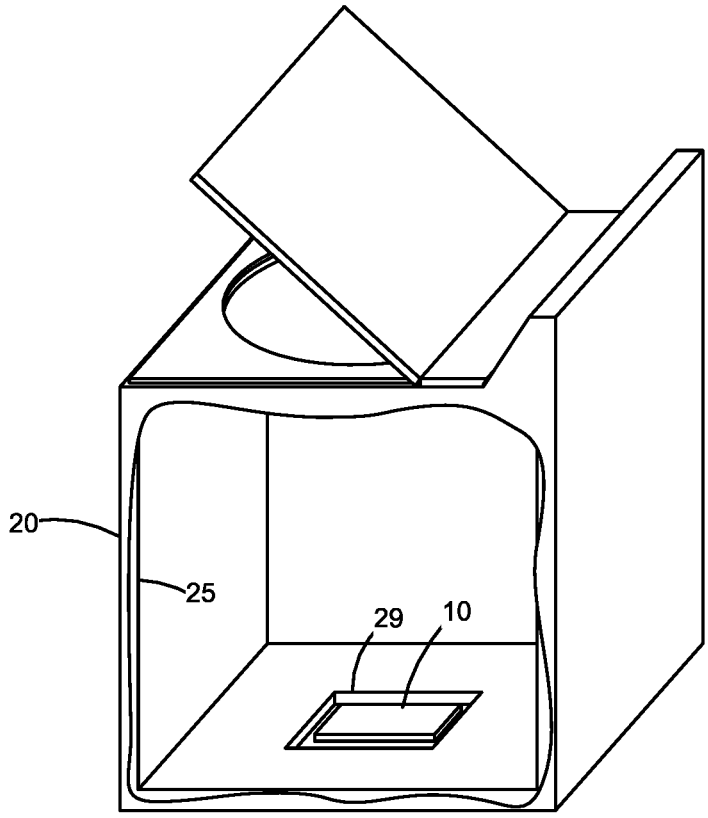
Figure 2:
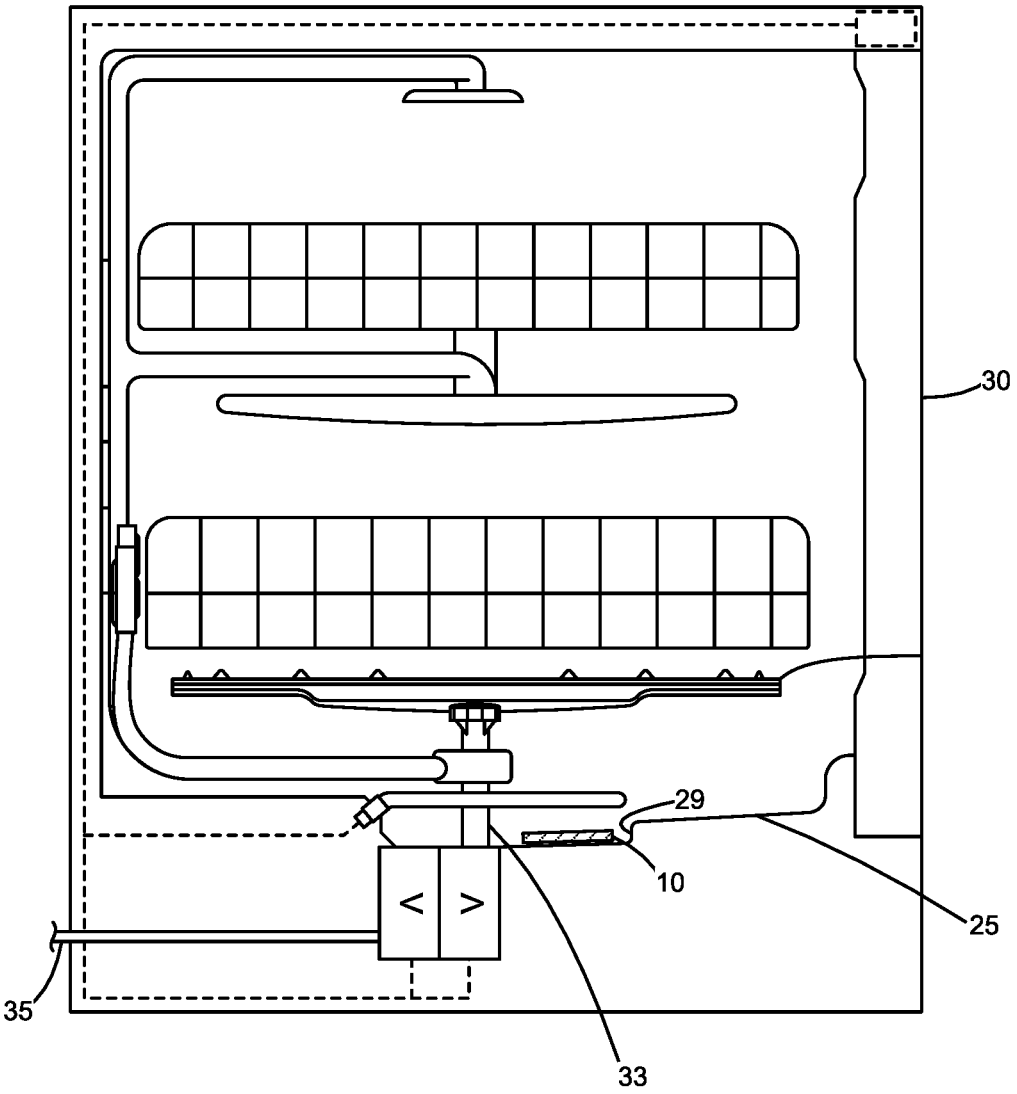
FIG. 2 is a simplified diagrammatic view of an appliance in the form of a dishwasher having a ceramic heater and its placement location.

With reference to FIGS. 1A and 1B, a ceramic heater 10 to heat fluid in an appliance, includes a clothes-washing machine 20. The appliance includes a reservoir 25 for holding fluid (water, in this instance). Near a bottom 27 or a sump 29 of the reservoir resides the ceramic heater. Similarly, FIG. 2 shows a ceramic heater 10 to heat fluid in an appliance in the form of a dishwasher 30. The heater resides near a bottom of a reservoir 25 that holds water. In this instance, the heater 10 is shown in a sump 29. A water pump 33 introduces water to the reservoir. It arrives at the appliance along a water line 35.

Figure 3A:
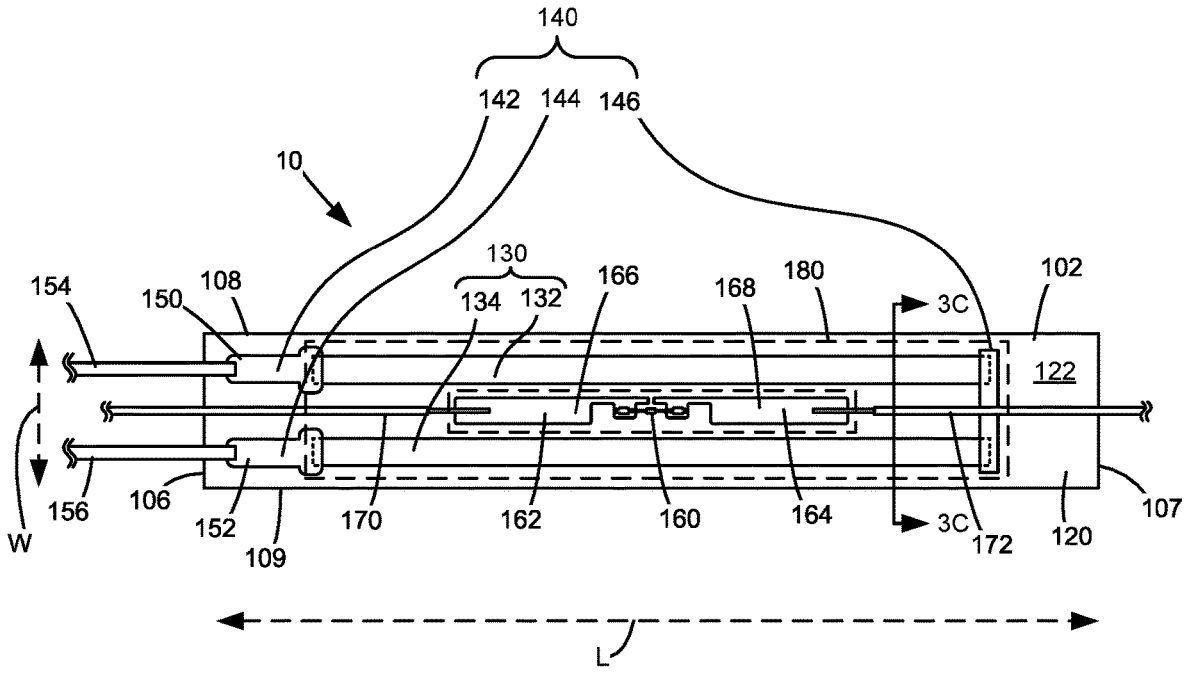
FIGS. 3A and 3B are diagrammatic plan views of opposite sides of a ceramic heater having thick-film printing on a substrate thereof.
Figure 3B:
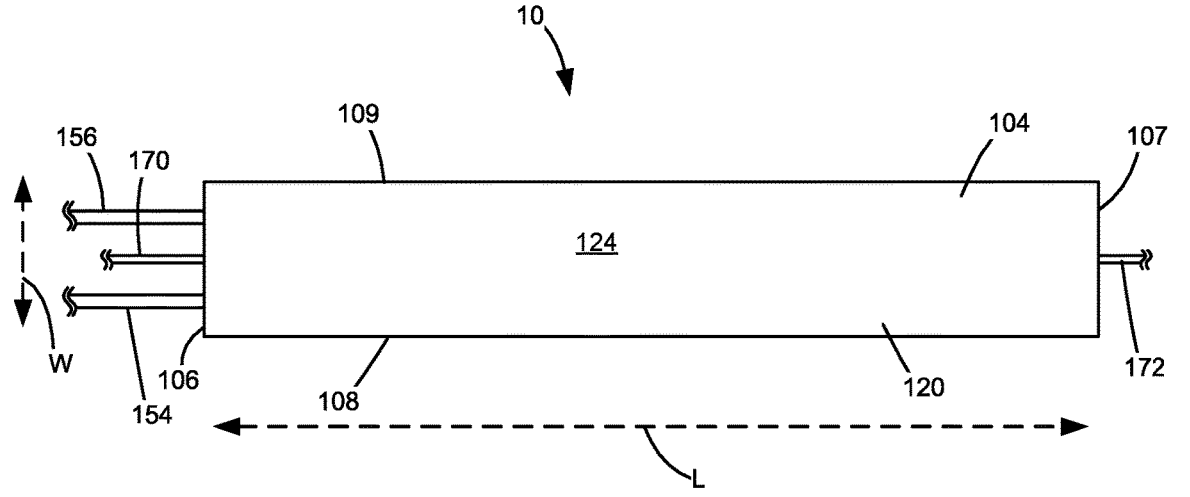

With reference to FIGS. 3A and 3B, a more detailed view of the ceramic heater 10 is shown according to an example embodiment. It includes a substrate 120 of a ceramic material, having an inner 102 and outer surface 104. Typically, the inner surface 102 faces away from the fluid being heated by the ceramic heater 10, while the outer surface 104 faces toward the fluid being heated. In various embodiments, the ceramic heater may be used alone (as shown) to heat the fluid or may accompany and mount to a heat transfer element 200 (FIGS. 5A, 5B), such as a metal plate. In the latter, the outer surface 104 also faces the heat transfer element and transfers heat to the heat transfer element which, in turn, heats the fluid in an appliance. In either embodiment, however, the ceramic heater 10 typifies a shape of a rectangular solid of length (L) by width (W) dimensions and a thickness (t) (FIG. 3C) extending between the inner and outer surfaces. Representative dimensions vary, but lengths ranging from three to twelve inches and widths of one to five inches are common. The thickness typifies one-half to three inches in some embodiments. The shape of the rectangular solid is best imagined as being bordered by four sides or edges, including lateral edges 106 and 107 and longitudinal edges 108 and 109, each having a smaller surface area than inner 102 and outer surface 104. Naturally, other shapes of the ceramic heater may be used as desired (e.g., cubes, cylinders, irregular, etc.).

The materials of the ceramic heater are any of a variety, but pure elements and compositions are representative. In various embodiments, the substrate 120 of the ceramic heater includes one or more layers of materials, such as aluminum oxide (e.g., commercially available 96% aluminum oxide ceramic). In other embodiments, the materials include but are not limited to aluminum nitride (e.g., commercially available 99% aluminum nitride), grade 430 stainless steel, and polyimide film. In any embodiment, the substrate 120 includes an outer face 124 that is oriented toward the outer surface 104 of heater 10 and an inner face 122 that is oriented toward the inner surface 102 of the heater 10. Outer face 124 and inner face 122 of the substrate 120 are positioned on exterior portions of the ceramic substrate 120 such that if more than one layer of ceramic substrate 120 is used, the outer face 124 and inner face 122 are positioned on opposed external faces of the ceramic substrate 120 rather than on interior or intermediate layers (not shown) of ceramic substrate 120. In the example embodiment illustrated, the outer surface 104 of heater 10 is formed by or coextensive with the outer face 124 of the substrate 120 as shown in FIG. 3B.

Also, the inner face 122 includes a series of one or more electrically resistive traces 130 and electrically conductive traces 140 positioned thereon. Resistive traces 130 include a suitable electrical resistor material such as, for example, silver palladium (e.g., blended in a ratio of nearly 70%/30% silver to palladium, excluding impurities). Conductive traces 140 on the other hand include a suitable electrical conductor material such as, for example, silver platinum. In the embodiment illustrated, resistive traces 130 and conductive traces 140 are applied to ceramic substrate 120 by way of thick-film printing. For example, resistive traces 130 include a resistor paste having a thickness of 10-13 microns when applied to ceramic substrate 120, and conductive traces 140 include a conductor paste having a thickness of 9-15 microns when applied to the ceramic substrate 120. Resistive traces 130 form the heating element of heater 10 while the conductive traces 140 provide electrical connections to and between resistive traces 130 in order to supply an electrical current to each resistive trace 130 to generate heat. In the example embodiment illustrated, heater 10 includes a pair of resistive traces 132, 134 that extend substantially parallel to each other (and substantially parallel to longitudinal edges 108, 109) along the lengthwise dimension (l) of heater 10. Heater 10 also includes a pair of conductive traces 142, 144 that each form a respective terminal 150, 152 of heater 10. Cables or wires 154, 156 may be connected to terminals 150, 152 in order to electrically connect resistive traces 130 and conductive traces 140 to a voltage source and control circuitry that selectively closes the circuit formed by resistive traces 130 and conductive traces 140 to generate heat. Conductive trace 142 directly contacts resistive trace 132, and conductive trace 144 directly contacts resistive trace 134.

Conductive traces 142, 144 are both positioned adjacent to lateral edge 106 in the example embodiment illustrated, but conductive traces 142, 144 may be positioned in other suitable locations on ceramic substrate 120 as desired. In this embodiment, heater 10 also includes a third conductive trace 146 that electrically connects resistive trace 132 to resistive trace 134, e.g., adjacent to lateral edge 107. Portions of resistive traces 132, 134 obscured beneath conductive traces 142, 144, 146 in FIG. 3A are shown in dotted line. In this embodiment, current input to heater 10 at, for example, terminal 150 by way of conductive trace 142 passes through, in order, resistive trace 132, conductive trace 146, resistive trace 134, and conductive trace 144 where it is output from heater 10 at terminal 152. Current input to heater 10 at terminal 152 travels in reverse along the same path.

In some embodiments, heater 10 includes a thermistor 160 positioned in close proximity to a surface of heater 10 to provide feedback regarding the temperature of heater 10 to control circuitry that operates the heater. In some embodiments, thermistor 160 is positioned on inner face 122 of ceramic substrate 120. In the example embodiment illustrated, thermistor 160 is welded directly to inner face 122 of the ceramic substrate 120. In this embodiment, heater 10 also includes a pair of conductive traces 162, 164 that are each electrically connected to a respective terminal of thermistor 160 and that each form a respective terminal 166, 168. Cables or wires 170, 172 may be connected to terminals 166, 168 in order to electrically connect thermistor 160 to, for example, control circuitry that operates heater 10 in order to provide closed loop control of heater 10. In the embodiment illustrated, thermistor 160 is positioned at a central location of inner face 122 of ceramic substrate 120, between resistive traces 132, 134 and midway from lateral edge 106 to lateral edge 107. In this embodiment, conductive traces 162, 164 are also positioned between resistive traces 132, 134 with conductive trace 162 positioned toward lateral edge 106 from thermistor 160 and conductive trace 164 positioned toward lateral edge 107 from thermistor 160. However, thermistor 160 and its corresponding conductive traces 162, 164 may be positioned in other suitable locations on ceramic substrate 120 so long as they do not interfere with the positioning of resistive traces 130 and conductive traces 140.

Figure 3C:
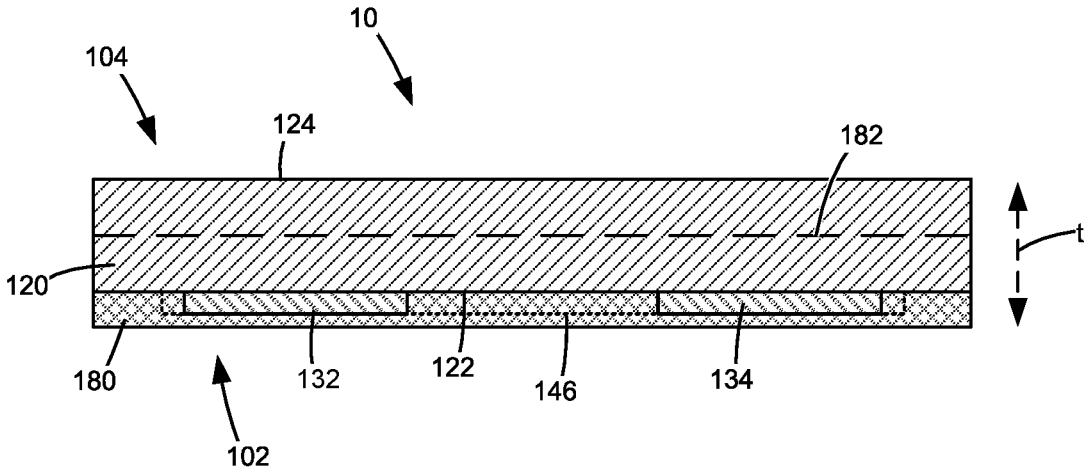
FIG. 3C is a cross-sectional view of the ceramic heater shown in FIGS. 3A and 3B taken along line 3C-3C in FIG. 3A.

With reference to FIG. 3C, a cross-sectional view of the heater 10 is taken along line 3C-3C in FIG. 3A. As such, the heater 10 includes one or more layers of printed glass 180 on inner face 122 of ceramic substrate 120. In the embodiment illustrated, glass 180 covers resistive traces 132, 134, conductive trace 146, and portions of conductive traces 142, 144 in order to electrically insulate such features to prevent electric shock or arcing. The borders of glass layer 180 are shown in dashed line in FIG. 3A. In this embodiment, glass 180 does not cover thermistor 160 or conductive traces 162, 164 because the relatively low voltage applied to such features presents a lower risk of electric shock or arcing. An overall thickness of glass 180 may range from, for example, 70-80 microns. FIG. 3C shows glass 180 covering resistive traces 132, 134 and adjacent portions of ceramic substrate 120 such that glass 180 forms the majority of inner surface 102 of heater 10. Outer face 124 of ceramic substrate 120 is shown forming outer surface 104 of heater 10 as discussed above. Conductive trace 146, which is obscured from view in FIG. 3C by portions of glass 180, is shown in dotted line. FIG. 3C depicts but a single layer of ceramic substrate 120, however the substrate 120 may include multiple layers as depicted by dashed line 182 in FIG. 3C.

As before, the ceramic heater 10 includes traces constructed by way of thick-film printing. In one example, resistive traces 130 are printed on a fired (not green state) ceramic substrate 120, which includes selectively applying a paste containing a resistor material to ceramic substrate 120 through a patterned mesh screen with a squeegee or the like. The printed resistor is then allowed to settle on ceramic substrate 120 at room temperature. The ceramic substrate 120 having the printed resistor is then heated at, for example, approximately 140-160 degrees Celsius for a total of approximately 30 minutes, including approximately 10-15 minutes at peak temperature and the remaining time ramping up to and down from the peak temperature, in order to dry the resistor paste and to temporarily fix resistive traces 130 in position. The ceramic substrate 120 having temporary resistive traces 130 is then heated at, for example, approximately 850 degrees Celsius for a total of approximately one hour, including approximately 10 minutes at peak temperature and the remaining time ramping up to and down from the peak temperature, in order to permanently fix resistive traces 130 in position. Conductive traces 140 and 162, 164 are then thick-film printed on ceramic substrate 120, which includes selectively applying a paste containing conductor material in the same manner as the resistor material. The ceramic substrate 120 having the printed resistor and conductor is then allowed to settle, dried and fired in the same manner as discussed above with respect to resistive traces 130 in order to permanently fix conductive traces 140 and 162, 164 in position. Glass layer(s) 180 are then printed in substantially the same manner as the resistors and conductors, including allowing the glass layer(s) 180 to settle as well as drying and firing the glass layer(s) 180. In one embodiment, glass layer(s) 180 are fired at a peak temperature of approximately 810 degrees Celsius, slightly lower than the resistors and conductors. Thermistor 160 is then mounted to ceramic substrate 120 in a finishing operation with the terminals of thermistor 160 directly welded to conductive traces 162, 164. As a result, thick-film printing resistive traces 130 and conductive traces 140 on fired ceramic substrate 120 provides more uniform resistive and conductive traces in comparison with conventional ceramic heaters, which include resistive and conductive traces printed on green state ceramics. The improved uniformity of resistive traces 130 and conductive traces 140 provides more uniform heating across outer surface 104 of heater 10 as well as more predictable heating thereof. Also, alternate embodiments contemplate that the resistive traces 130 and/or thermistor 160 may be positioned on the outer face 124 of ceramic substrate 120 along with corresponding conductive traces as needed to establish electrical connections thereto. Glass 180 may cover the resistive traces and conductive traces on outer face 124 and/or inner face 122 of ceramic substrate 120 as desired in order to electrically insulate such features.

In still other embodiments, the ceramic heater of the present disclosure may include resistive and conductive traces in many different patterns, layouts, geometries, shapes, positions, sizes and configurations as desired, including resistive traces on an outer surface of the heater, an inner surface of the heater and/or an intermediate layer of the ceramic substrate of the heater. Other components (e.g., a thermistor and/or a thermal cutoff) may be positioned on or against a face of the heater as desired. As discussed above, ceramic substrates of the heater may be provided in a single layer or multiple layers, and various shapes (e.g., rectangular, square or other polygonal faces) and sizes of ceramic substrates may be used as desired. In some embodiments where the heater includes a ceramic substrate having rectangular faces, a length of the ceramic substrate along a longitudinal dimension may range from, for example, 80 mm to 120 mm, and a width of the ceramic substrate along a lateral dimension may range from, for example, 15 mm to 24 mm. In some embodiments where the heater includes a ceramic substrate having square faces, a length and width of the ceramic substrate may range from, for example, 5 mm to 25 mm (e.g., a 10 mm by 10 mm square). Curvilinear shapes may be used as well but are typically more expensive to manufacture. Printed glass may be used as desired on the outer face and/or the inner face of the heater to provide electrical insulation.

During production, the ceramic heaters of the present disclosure are preferably produced in an array for cost efficiency with each heater in a particular array having substantially the same construction. Preferably, each array of heaters is singulated into individual heaters after the construction of all heaters in the array is completed, including firing of all components and any applicable finishing operations. In some embodiments, individual heaters are separated from the array by way of fiber laser scribing. Fiber laser scribing tends to provide a more uniform singulation surface having fewer microcracks along the separated edge in comparison with conventional carbon dioxide laser scribing. In other embodiments, construction of the ceramic heaters includes non-standard or custom sizes and shapes to match the heating area required in a particular appliance. However, for larger heating applications, this approach generally increases the manufacturing cost and material cost of the heaters significantly in comparison with constructing modular heaters in standard sizes and shapes.

In any appliance to heat fluid with one or more ceramic heaters, the one or more heaters may be mounted to or positioned against a heat transfer element having high thermal conductivity to provide heat to a desired heating area. The heaters may be produced according to standard sizes and shapes with the heat transfer element sized and shaped to match the desired heating area. In this manner, the size and shape of the heat transfer element can be specifically tailored or adjusted to match the desired heating area rather than customizing the size and shape of the heater(s). The number of heaters attached to or positioned against the heat transfer element can be selected based on the desired heating area and the amount of heat required.

In the embodiments, the heat transfer element can be formed from a variety of high thermal conductivity materials, such as aluminum, copper, or brass. In some embodiments, aluminum is advantageous due to its relatively high thermal conductivity and relatively low cost. Aluminum that has been hot forged into a desired shape is often preferable to cast aluminum due to the higher thermal conductivity of forged aluminum. Hot forged aluminum is over 50% higher in thermal conductivity than cast aluminum. Heat transfer may be also improved by applying a gap filler, such as a thermal pad, adhesive or grease, between adjoining surfaces of each ceramic heater and the heat transfer element in order to reduce the effects of imperfections of these surfaces on heat transfer. Thermally insulative pads may be applied to portions of the heaters that face away from the heat transfer element (e.g., the inner surface of each heater) in order to reduce heat loss, improving heating efficiency. Springs or other biasing features that force the heaters toward the heat transfer element may be further used to improve heat transfer.

Figure 4A:
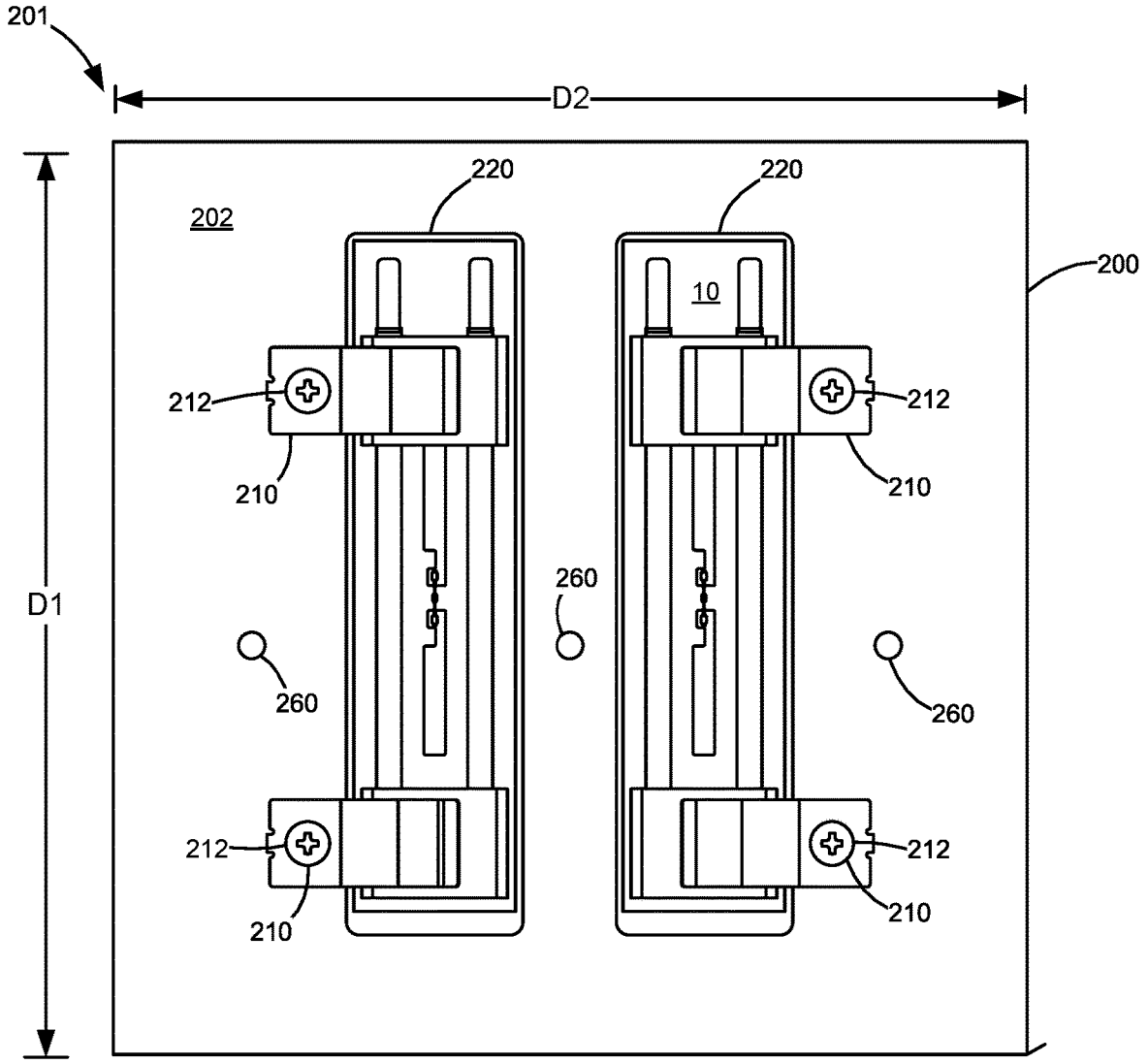
FIGS. 4A and 4B are related diagrammatic planar and side views of plural ceramic heaters mounted with a heat transfer element embodied as an aluminum plate of forged aluminum, including through holes to induce turbulent fluid flow.
Figure 4B:
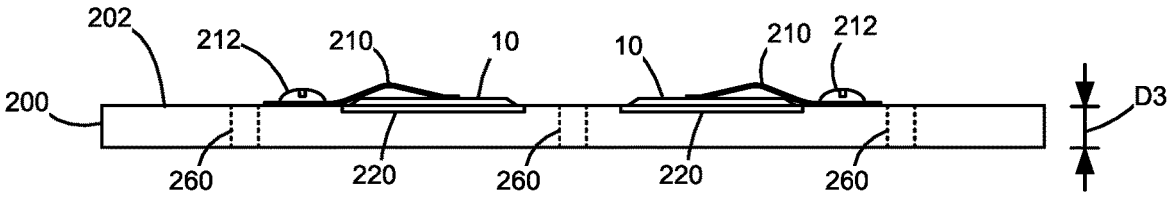

In one particular embodiment, reference is taken to FIGS. 4A and 4B, whereby two ceramic heaters 10 are connected to a heat transfer element 200. The heat transfer element typifies a plate of aluminum in the shape of a rectangular solid. Preferably the plate is forged aluminum, whereby the ceramic heaters 10 attach their inner surface to an undersurface 202 of the plate. An opposite, top surface 201 of the plate directly faces the fluid in the appliance for heating the fluid.

One or more spring clips 210 hold in place the heaters and one or more mounting screws 212 secure the clips to the undersurface 202. A thermally conductive graphite film 220 resides between the ceramic heaters and the plate to improve heat transfer. It has a thickness of about 0.2 mm. The dimensions of the plate depend upon application, but contemplate distances D1 and D2 and thickness D3 of about 10-20 inches, 5-12 inches and 0.5-2 inches, respectively. Of course, the plate may have other shapes and sizes per application for positioning to spread heat from the ceramic heaters and into a fluid for heating. The thermal conductivity and relative thinness of the plate results in a relatively low thermal mass, which reduces the amount of time required to heat and cool the plate and, in turn, the fluid in the appliance.

Figure 5:
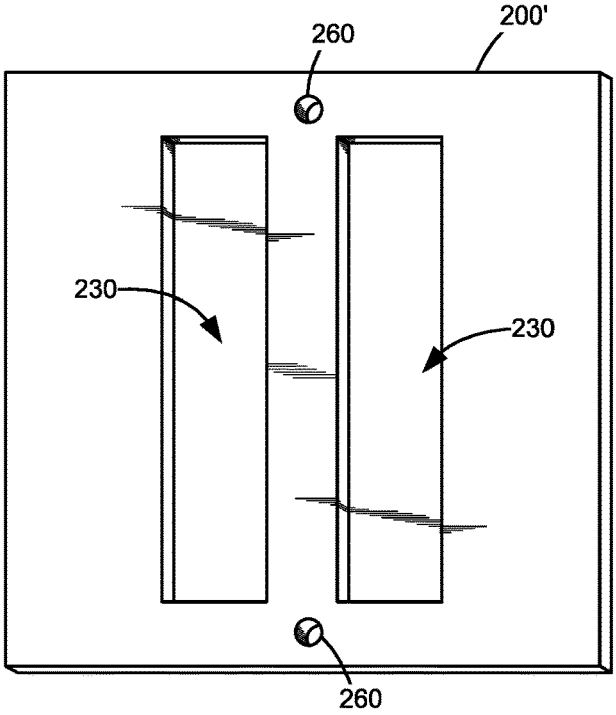
FIG. 5 is a simplified diagrammatic view of a heat transfer element having one or more cavities for mounting therein ceramic heaters, including through holes to induce turbulent fluid flow.
Figure 6:
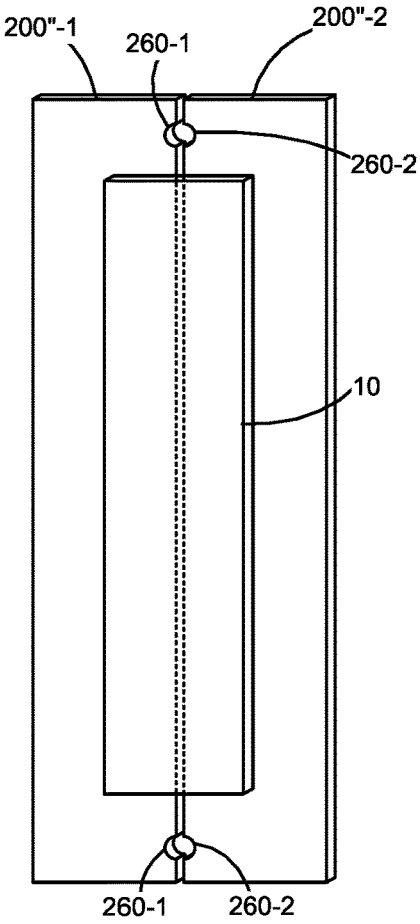
FIG. 6 is a simplified diagrammatic view of a heat transfer element fitted about a ceramic heater, including sectionals forming through holes when fitted to induce turbulent fluid flow.
Figure 7:
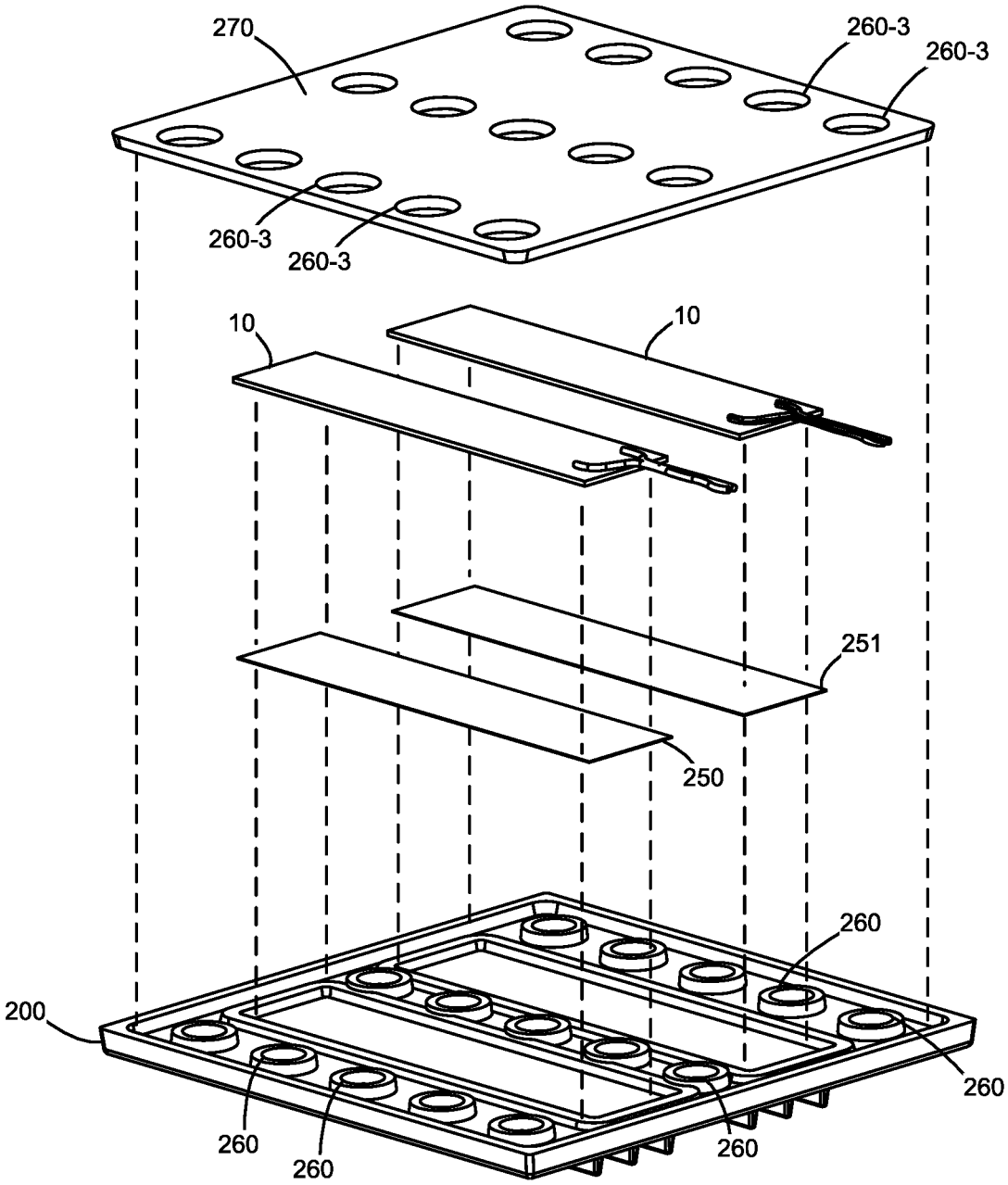
FIG. 7 is an exploded diagrammatic view of ceramic heaters and a heat transfer element with arrays of through holes to induce turbulent fluid flow.

With reference to FIGS. 5 and 6, further embodiments of a heat transfer element 200', 200" contemplate alternatives for retaining one or more ceramic heaters. In FIG. 5, a plurality of wells or cavities 230 in the heat transfer element 200' are sized and shaped to fit therein the ceramic heaters (not shown). In FIG. 6, the heat transfer element 200" includes bifurcated elements 200"-1, 200"-2 that fit around a ceramic heater thereby retaining it in place. In any, gap fillers to improve heat transfer from the heaters to the heat transfer element are contemplated as are mechanical devices, clips, springs, screw, bolts, and the like to hold in place the heaters. Also, still, the heat transfer elements of FIGS. 4A, 4B, 5, and 6, further include one or more holes through the thickness of the heat transfer element to introduce turbulent flow of fluids being heated. That is, fluid is allowed to pass through the holes during use thereby promoting turbulence in the flow of water in dishwashers and clothes-washing machines, for example, and the holes are expected to reduce thermal mass by giving to the plate greater surface area in comparison to plates without holes. The holes 260 can reside as simply through holes drilled through a plate, for instance, or can be bifurcated sectionals or halves 260-1, 260-2 that when joined together form a single hole through the heat transfer element 200". The holes can be formed in a secondary process or hot forged during hot forging of the conductor plate. In FIG. 7, an exploded view showing a heat transfer element 200 has pluralities of holes 260 (only a few labeled) in three arrays on either sides of the ceramic heaters 10. A gap filler 251 resides between the heaters and the heat transfer element to improve heat transfer. On an opposite side of the heaters 10, an insulator resides and such has holes 260-3 corresponding to the holes 260 through the plate. In this design, more holes through the plate increases the surface area of the heat transfer element and induces more turbulent fluid flow of the fluid in the appliance.

Skilled artisans should now appreciate the present disclosure improves both the efficiency and time-to-heating of fluid in both clothes-washing machines and dishwashers by attaching one or more ceramic heaters, with or without one or more heat transfer elements, near a bottom or sump of a fluid holding reservoir. In the instance of a clothes-washing machine, the present disclosure eliminates or reduces the volume of the sump compared to the prior art so that it takes less water to generate steam, thereby reducing the power required and the time to generate steam. For a dishwasher, a heat transfer element in direct contact with the water in the bottom of the appliance improves the heating efficiency and heats water faster.

The foregoing description of several structures and methods of making the same has been presented for purposes of illustration. It is not intended to be exhaustive or to limit the claims. Modifications and variations to the description are possible in accordance with the foregoing. It is intended that the scope of the invention be defined by the claims appended hereto.

The invention claimed is:

1. An appliance for heating water, comprising:

a reservoir for holding the water;

a forged aluminum plate for contacting the water on a side thereof;

two ceramic heaters mounted to the forged aluminum plate on an opposite side thereof, each of the ceramic heaters having one or more thick-film printed electrically resistive traces on a substrate that heat upon activation, the traces providing heat to a surface area of said each of the ceramic heaters that transfers to the opposite side of the aluminum plate;

a plurality of holes through a thickness of the forged aluminum plate allowing the water to pass through the thickness during use, the two ceramic heaters being rectangular in surface area and the plurality of holes extend lengthwise in three arrays on either longitudinal sides of the rectangular surface area; and an insulator on a side of the two ceramic heaters opposite said opposite side thereof, the insulator having a number of holes in arrays matching a number of the plurality of holes through the thickness of the forged aluminum plate.

2. The appliance of claim 1, further including a graphite film between said each of the two ceramic heaters and the forged aluminum plate.

3. The appliance of claim 1, wherein each of the three arrays has five holes.

4. The appliance of claim 1, further including wherein the aluminum plate has a cavity for retaining therein the two ceramic heaters.

5. The appliance of claim 1, further including two spring clips to retain said each of the two ceramic heaters.

* * * * *